US005357654A

United States Patent [19]

Hsing-Chi

[11] Patent Number: 5,357,654

[45] Date of Patent: Oct. 25, 1994

[54] RATCHET DIVING MASK STRAP

[76] Inventor: Hsieh Hsing-Chi, 1 Fl, No. 22, Lane 125, Jen Ai Street, Sanchung City, Taipei Hsien, Taiwan

[21] Appl. No.: 33,924

[22] Filed: Mar. 19, 1993

[51] Int. Cl.[5] ..... A42B 3/04; A61F 9/02

[52] U.S. Cl. ..... 24/68 B; 24/274 WB; 2/418

[58] Field of Search ..... 24/274 R, 274 WB, 68 B, 24/68 R; 2/418, 420, 428, 452

[56] References Cited

U.S. PATENT DOCUMENTS

| | | | |
|---|---|---|---|
| 2,205,741 | 6/1940 | Bowers | 2/418 X |
| 2,205,742 | 6/1940 | Bowers | 2/418 X |
| 3,090,046 | 5/1963 | Bowers | 24/274 WB X |
| 3,325,824 | 6/1967 | Donegan | 24/68 B X |
| 3,605,204 | 9/1971 | Amundsen | 2/452 X |
| 4,112,521 | 9/1978 | Uke | 2/428 X |
| 4,607,398 | 8/1986 | Faulconer | 2/452 |
| 4,942,628 | 7/1990 | Freund | 2/418 X |

*Primary Examiner*—Richard E. Gluck

[57] ABSTRACT

The present invention is to offer a ratchet diving mask strap which can be adjusted to a desirable tightness even under water through a process of two-piece opposite direction displacement tightening by turning the adjusting knob to tighten the two sides of strap, and consists of one each elastic strap on the left and right, a guard cover an upper rack, a lower rack, a gear, an adjusting knob and a check device, wherein each elastic strap is combined with the left and right sides of the upper and lower racks to form a strip, the upper and lower racks are mutually overlapped and disposed in the guard cover, a gear disposed in the tooth grooves of upper and lower racks to engage with the upper and lower racks, and the gear is combined with the adjusting knob, turning the adjusting knob can displace the upper and lower racks left and right and further pull the left and right elastic strap so as to adjust the tightness of said strap, and the check device can check the adjusting knob to keep the tightness of mask strap.

1 Claim, 5 Drawing Sheets

RATCHET DIVING MASK STRAP

BACKGROUND OF THE INVENTION

1. Field of the Invention

The present invention is related to a ratchet diving mask strap of which the tightness adjustment is more convenient, practicable and comfortable even under water.

2. Description of the Prior Art

As one of the three diving necessities (diving mask, snorkel and fins), the diving mask is prerequisite equipment for the divers who require the mask to fit faces in addition to the mask lens being very transparent. Such demand for safety depends on the combination of mask skirt and mask strap of diving mask. A clearance between the mask skirt and diver's face or a poor tightness of mask strap will result in water leakage and permeation to unfavorably affect the function of a diving mask as a whole. Of course, the divers know that the deeper they dive, the more obvious the effect on the water leakage and permeation of diving mask, therefore, the suitable tightness adjustment of mask strap is very important.

The major structure of diving mask in general comprises a frame(11), a skirt(12) and a strap(13) as shown in FIG. 1, and the strap(13) of conventional diving mask is integrally molded into a strap made of elastic material such as rubber, silicone, wherein the two ends of said strap(13) are respectively folded reversely to connect the two sides of frame(11), and the tightness adjustment thereof is roughly done by means of pulling the reversely folded strap in the position of connection to an extent of neither too tight nor too loose so far as the elastic force that it is said strap(13) is concerned. However, adjusting too loose will lead to water permeation and leakage under water, but adjusting too tight will considerably pressurize the diver's head and face, his head will feel uncomfortable so he cannot dive for a long time. In addition, the said adjustment has to be done before diving but cannot be done any more under water. It is necessary to improve the limitation on use and the undesirable safety.

In view of the foregoing drawbacks of the conventional diving mask strap, the present inventor offers an adjustable diving mask strap which adopts the two-piece opposite displacement tightening method—to turn the adjusting knob to tighten the two sides of strap to an extent of suitable tightness to combine the effect of both the elastic force tightening and the knob adjusting, namely, suitable tightness, comfortable wearing and considerable practice, and the mask strap tightness can be adjusted under water from time to time as required.

SUMMARY OF THE INVENTION

The present invention is characterized in the following design: an upper rack and a lower rack are overlapped and disposed in a guard cover, each of these racks includes a depression area with a row of teeth therein. A first upper rack has the teeth on an upper side of the depression, and a second lower rack has the teeth on a lower side of the depression, a gear between the upper and lower racks in the guard cover is designed to engage with the teeth on the different sides of these racks through an adjusting knob. Turning the adjusting knob actuates the gear and displaces the upper and lower racks left and right so as to tighten the elastic strap on the outer sides of these racks and achieve the purpose of tightening by rotation and elastic force.

The present invention is further characterized in the following design: a check device beside the adjusting knob consists of a turning knob and a spring, wherein the turning knob has a protruding pin with a unidirectional inclined plane which can let the adjusting knob pass unidirectionally but prevent the adjusting knob from turning back adversely and accidently, and the spring pushes the turning knob in place by its elastic force so as to achieve the check function of adjusting knob and to keep the tightness of mask strap as a whole.

DESCRIPTION OF THE PREFERRED EMBODIMENT

Figure 1:
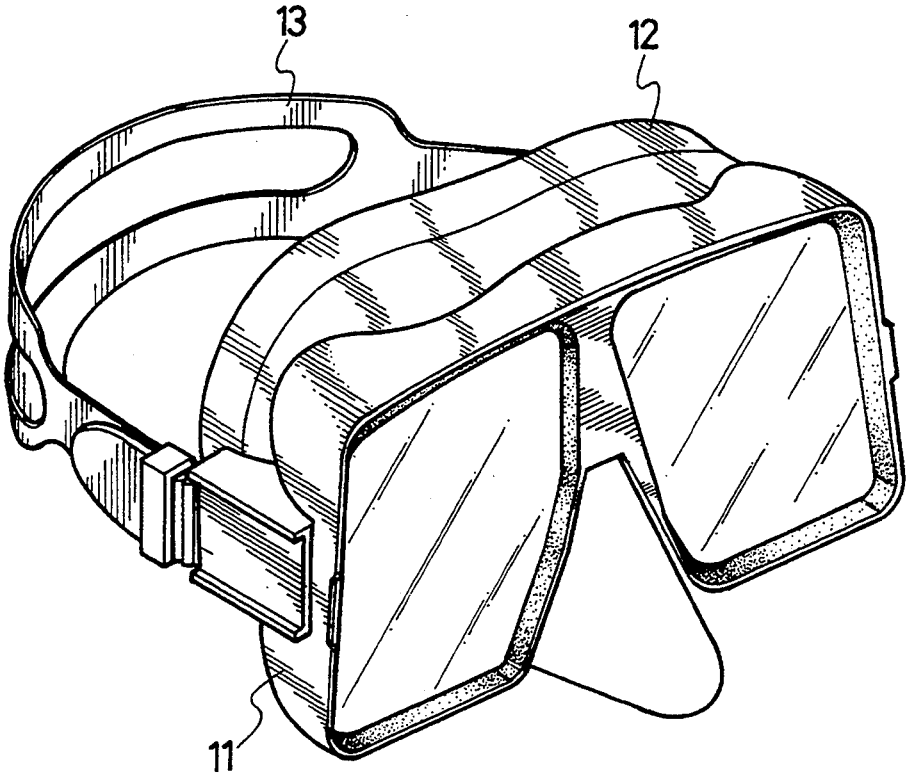
FIG. 1 PRIOR ART
FIG. 1 is an elevational view of conventional diving mask strap combined with the diving mask.
Figure 2:
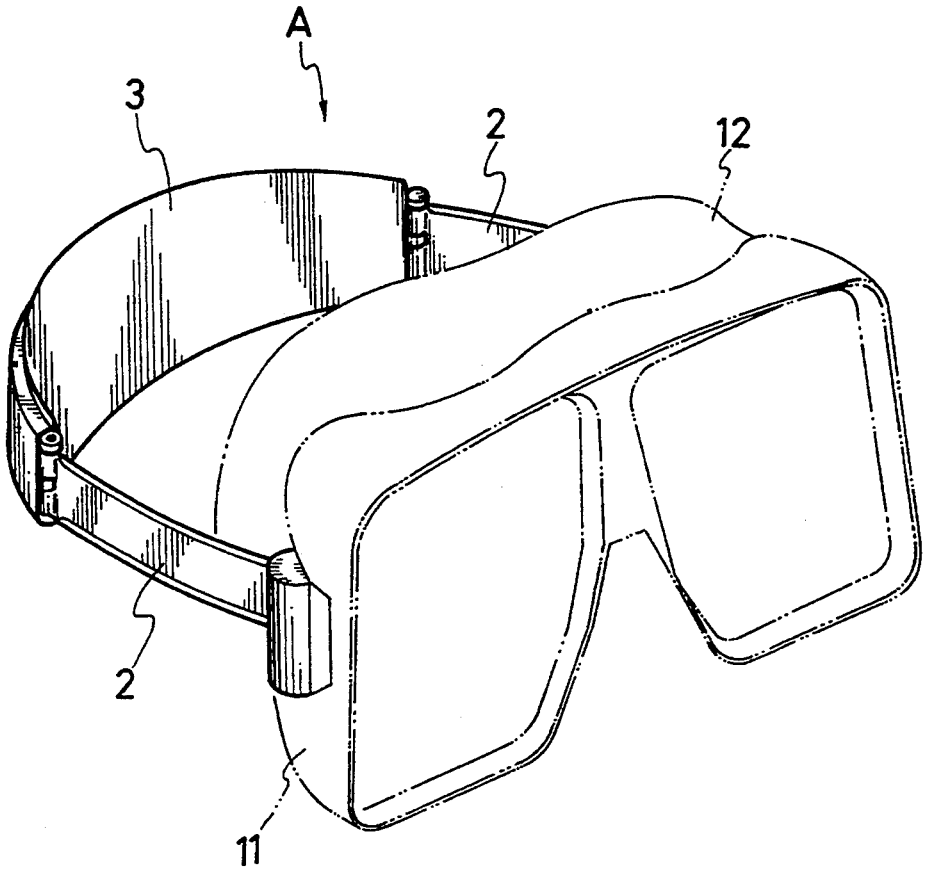
FIG. 2 is an elevational view of the present invention combined with the diving mask.

As shown in FIGS. 1 and 2 for a comparison, the conventional diving mask strap(13) is made of an elastic material and integrally molded into a strap and the two sides thereof are connected to the frame(11) by means of reversely folded tightening, and certainly the adjustment thereof has be done on these two sides, too. So far as the present invention is concerned, the elastic strap on the two sides are fixed and connected to the frame(11), and the wide and large guard cover thereof is a portion of the mask strap which can be suitably and comfortably worn by the diver to achieve the purpose of fixation.

Figure 3:
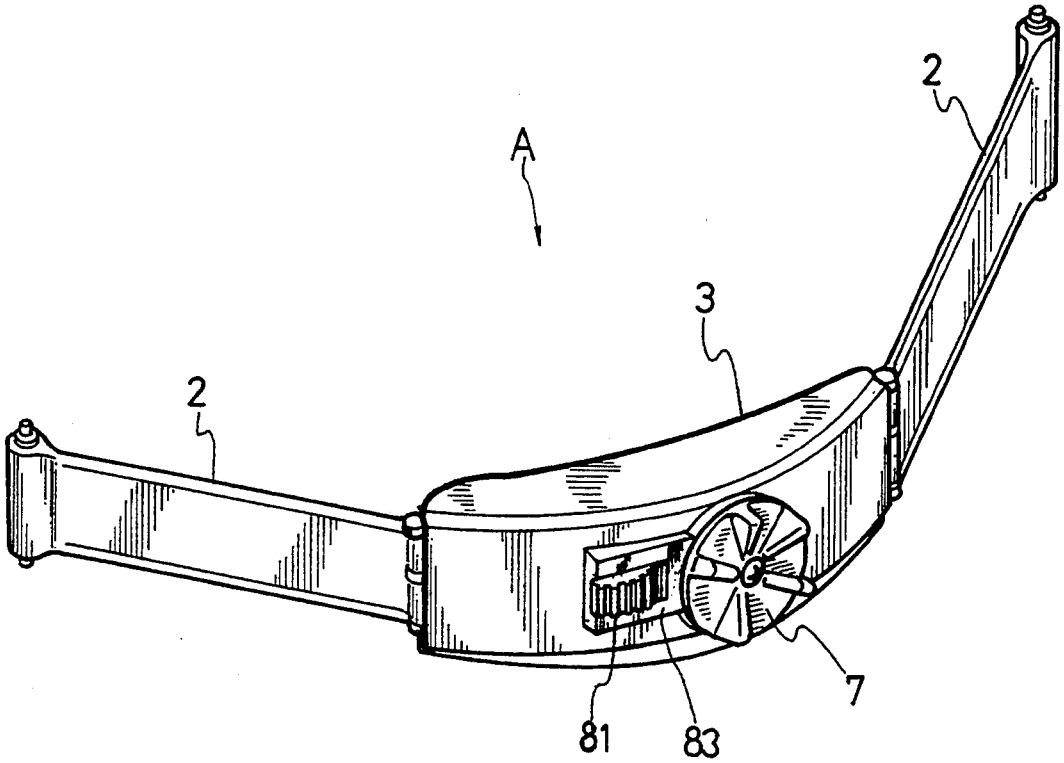
FIG. 3 is an elevational appearance view of the present invention.
Figure 4:
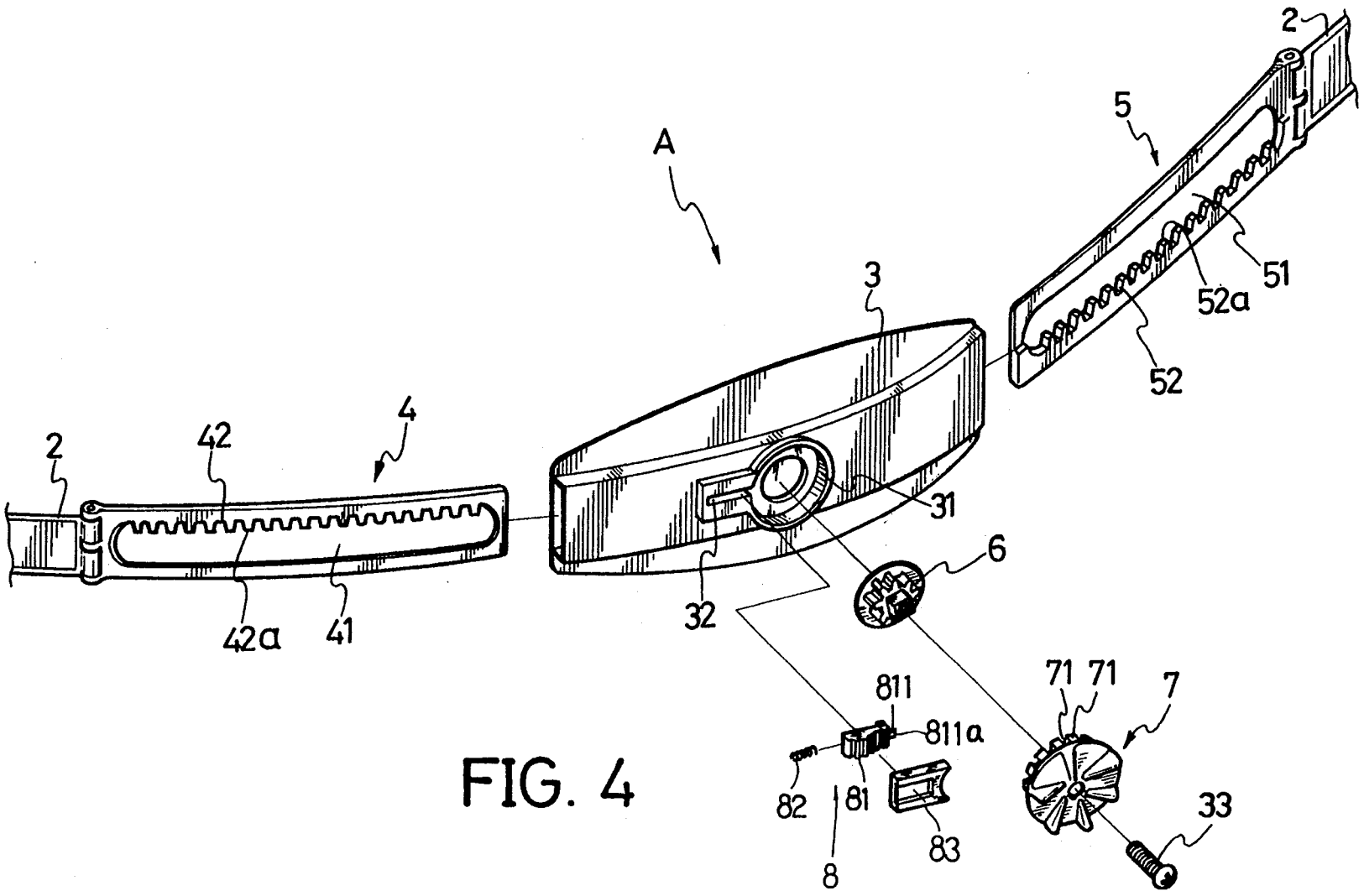
FIG. 4 is a breakdown view of the present invention.

As shown in FIGS. 3 and 4, the ratchet diving mask strap(A) according to the present invention consists essentially of one each elastic strap(2) on the left and right, a guard cover(3), an upper rack(4), a lower rack(5), a gear(6), an adjusting knob(7) and a check device(8), wherein one end of elastic strap(2) is combined with the side of diving mask frame(11), and another end thereof is connected to the upper and lower racks(4),(5) to form a two-piece strap as a strip, and these two racks(4),(5) are overlapped and inserted in the guard cover(3) which is hollow and slightly arced outward, the back of said cover(3) is a wide and smooth surface, and the front thereof is provided with an adjusting knob seat(31) and a check catch seat(32) to contain the adjusting knob(7) and the check device(8) therein respectively.

The foregoing upper and lower racks(4),(5) include depression areas (41),(51), wherein a row of teeth(42) with a plurality of continuous teeth(42*a*) are provided to the inner edge on the upper side of tooth groove(41) of upper rack(4), and a row of teeth(52) with a plurality of continuous teeth(52*a*) are provided to the inner edge on the opposite side (namely, the lower side) of tooth groove(51) of lower rack(5), these two racks(4),(5) are mutually overlapped to form a bilateral row of teeth.

Figure 5:
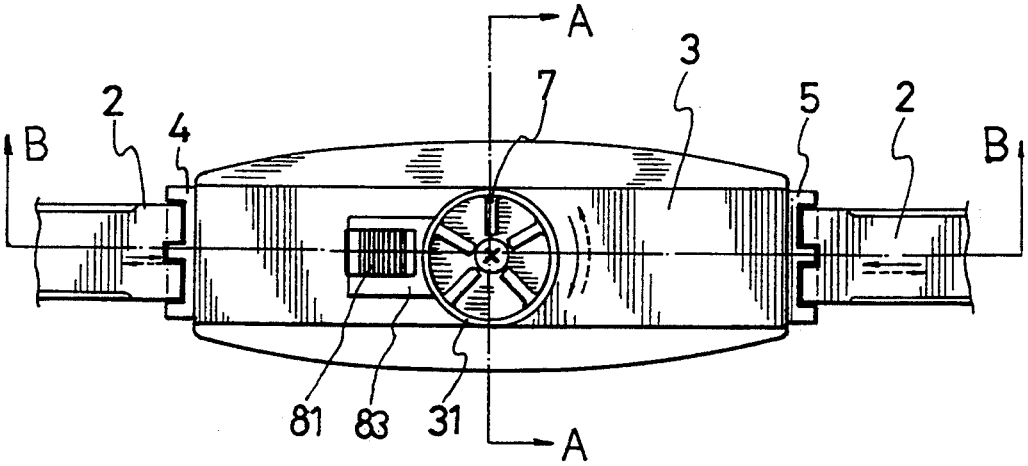
FIG. 5 is a front view of the present invention and shows the action thereof.

The gear(6) is between and engaged with the bilateral rows of teeth(42),(52) on the tooth grooves(41),(51) and in a guard cover(3) to combine with the adjusting knob(7) by means of a bolt(33) so as to turn the adjusting knob(7) and the gear(6) and to force the upper and lower racks(4),(5) to be displaced left and right and to further pull the left and right elastic strap(2) extending outward or retracting inward in order to achieve the action of adjusting the mask strap(A) as shown in FIG. 5.

Figure 7:
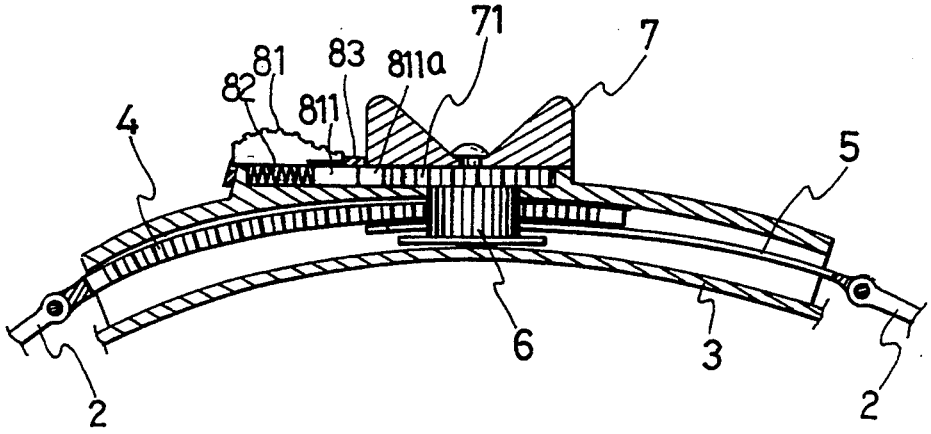
FIG. 7 is a section view taken along B—B line of FIG. 6.

As shown in FIG. 4, a check catch seat(32) is provided to one side of adjusting knob seat(31) of guard cover(3), the foregoing check device(8) consisting of a latch button(81) and a spring(82) is in the catch seat(32), the protruding pin(811) is at the front end of latch button, and the rear end of protruding pin is nested with the spring(82) so that the elastic force of spring(82) keeps the latch button (81) in a state of displacing forward, namely, to keep the protruding pin(811) extending into any one of a plurality of tooth recesses(71) on the bottom of adjusting knob(7) as shown in FIG. 7. The front end of protruding pin(811) has a unidirectional inclined plane(811*a*) permits the unidirectional pass of adjusting knob(7) such as clockwise rotation so as to gradually adjust the tightness of mask strap(A) as a whole through the adjusting knob(7) and to prevent the adjusting knob(7) from accidently and adversely turning and to prevent the mask strap belt(A) from accidently relaxing. A cover(83) outside the check catch seat(32) covers the latch button(81) and spring(82) so as to prevent the latch button(81) and spring(82) from coming off, and a portion of the exterior protrudes beyong the cover(83) so that the user can more easily operate the latch button(81).

Figure 6:
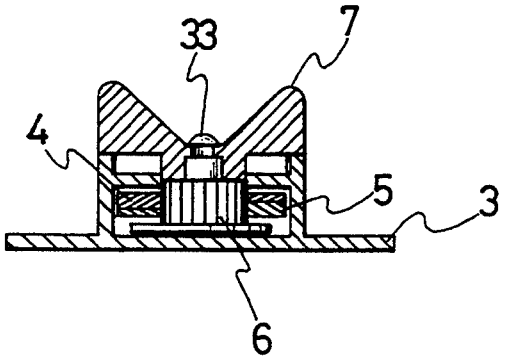
FIG. 6 is a section view taken along A—A line of FIG. 5.

As shown in FIGS. 5, 6 and 7, when we intend to adjust more tightness of mask strap(A), all we do is to directly turn the adjusting knob(7) along one direction such as clockwise as shown by the full line in FIG. 5 so as to actuate the gear(6) turning clockwise, the upper and lower racks(4),(5) displacing toward the opposite direction and the elastic strap(2) on two sides contracting gradually until a suitable tightness is achieved. In the process of said adjustment, the front protruding pin(811) of the latch button of check device(8) permits the clockwise pass of adjusting knob(7) but can prevent the adjusting knob(7) from turning counterclockwise and avoid the mask strap(A) from accidently relaxing. When we intend to loosen the tightness of mask strap(A), first to turn the latch button to let its front protruding pin(811) disengage from the tooth recess(71) at the bottom of adjusting knob(7) and then to turn the adjusting knob(7) counterclockwise so as to actuate the gear(6) turning counterclockwise, the upper and lower racks(4),(5) displacing toward the opposite direction, and the elastic strap(2) on two sides restoring their original state until a suitable tightness is achieve. The foregoing operation for adjusting tight or loose can be done in any circumstances at all times and even when the diver is under water.

In view of the above, the present invention is really a novel and practical diving mask strap which is a breakthrough on the conventional one and characterized in the following advantages:

1. The present invention can be adjusted to a desirable size in line with the size of user's head.
2. The problem of undesirably adjusting the conventional strap can be eliminated so as to achieve a desirable tightness.
3. The users feel comfortable to wear the present invention which has a wide guard cover.
4. The present invention can be micro-adjusted so as to meet with the pressure of diving depth.
5. The present invention can be adjusted under water.
6. The present invention can be quickly and conveniently adjusted to meet the demand of real comfort so as to step up its safety relatively.

I claim:

1. A ratchet diving mask strap comprising:

two elastic straps with a first end of each strap secured to a frame of a diving mask, a second end of the straps being connected with upper and lower racks, respectively the upper rack including a depression area with a row of teeth on an upper inner surface thereof, the lower rack including a depression area with a row of teeth on an lower inner surface thereof, with the upper and lower racks being disposed in a guard cover so as to overlap, thereby forming a region with teeth on a top side and teeth on a lower side;

the guard cover including an arced hollow body with an adjusting knob seat and a check catch seat on a front side thereof;

a gear disposed in the guard cover and engaged with the teeth so that the gear can actuate the upper and lower racks, thus tightening and loosening the elastic strap when the gear is turned;

an adjusting knob including a plurality of tooth recesses at a lower end thereof, the adjusting knob being disposed in an adjusting knob seat in the guard cover and connected with the gear; and a check device comprising a latch button and a spring disposed in the check catch seat of the guard cover, a protruding pin provided at a front end of the latch button, the rear end of the protruding pin being nested with the spring, the spring thereby urging the protruding pin into the tooth recesses of the adjusting knob, the front end of the protruding pin including a unidirectional inclined plane which permits the adjusting knob to run in only one direction when the protruding pin is engaged.

* * * * *